United States Patent [19]

Solloway

[11] Patent Number: 4,468,023

[45] Date of Patent: Aug. 28, 1984

[54] AQUATIC NECK EXERCISE ASSEMBLY

[76] Inventor: Daniel S. Solloway, 1315 18th St., Woodward, Okla. 73801

[21] Appl. No.: 420,021

[22] Filed: Sep. 20, 1982

Related U.S. Application Data

[63] Continuation-in-part of Ser. No. 310,788, Oct. 13, 1981, Pat. No. 4,416,451, which is a continuation-in-part of Ser. No. 79,966, Sep. 28, 1979, Pat. No. 4,311,306.

[51] Int. Cl.[3] ..... A01B 23/00

[52] U.S. Cl. ..... 272/94; 441/124

[58] Field of Search ..... 272/94, 71, 1 B, 1 R, 272/130, 93; 441/124, 136; 273/424; 46/1 F; 2/68

[56] References Cited

U.S. PATENT DOCUMENTS

| | | | |
|---|---|---|---|
| 2,295,659 | 9/1942 | Howland | 2/68 |
| 2,938,727 | 5/1960 | Nosak | 272/71 X |
| 3,283,349 | 11/1966 | White | 441/124 |
| 3,809,397 | 5/1974 | Gruenewald | 273/26 B |
| 3,913,907 | 10/1975 | Baker | 272/93 |
| 4,300,759 | 11/1981 | Caplan | 272/130 |
| 4,311,306 | 1/1982 | Solloway | 272/122 |

FOREIGN PATENT DOCUMENTS

| | | | |
|---|---|---|---|
| 487905 | 11/1952 | Canada | 272/94 |

*Primary Examiner*—Richard J. Johnson
*Attorney, Agent, or Firm*—Thomas W. Tolpin

[57] ABSTRACT

An aquatic helmet exercise assembly is provided which can be interchangeably used by men, women and children alike in the water without substantial modification by simply adjusting the chin straps. The aquatic helmet exercise assembly permits a large range of head movements and controlled use of fluid resistive forces for strengthening the neck, back and stomach muscles. The exercise assembly has upright fins and an optional rounded or pyramid-shaped crown.

7 Claims, 27 Drawing Figures

100
106
106
108
102
104

114
116
118
110
112

124
122
120

128
126b
126a
130
132

138
136
140
134

152
148
149
150
151
154
142
144
146

174
162
172
164
166
160
164a
170

Fig. 14.
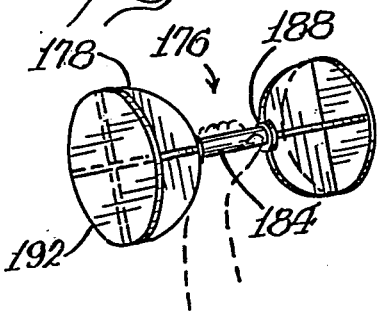
Fig. 15.
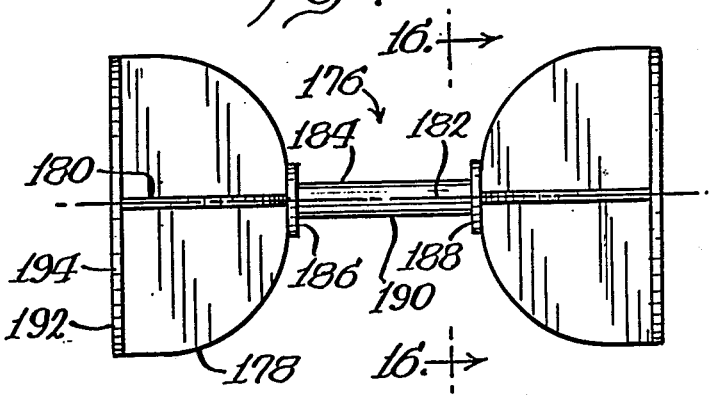
Fig. 16.
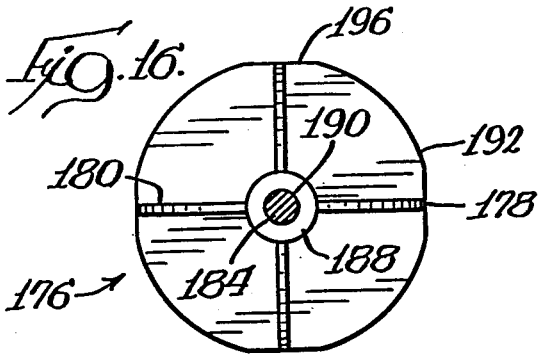
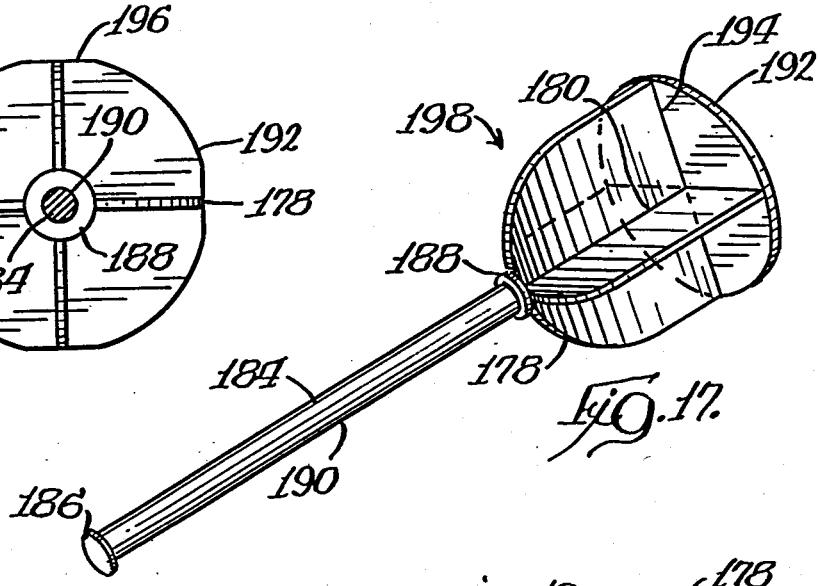
Fig. 17.
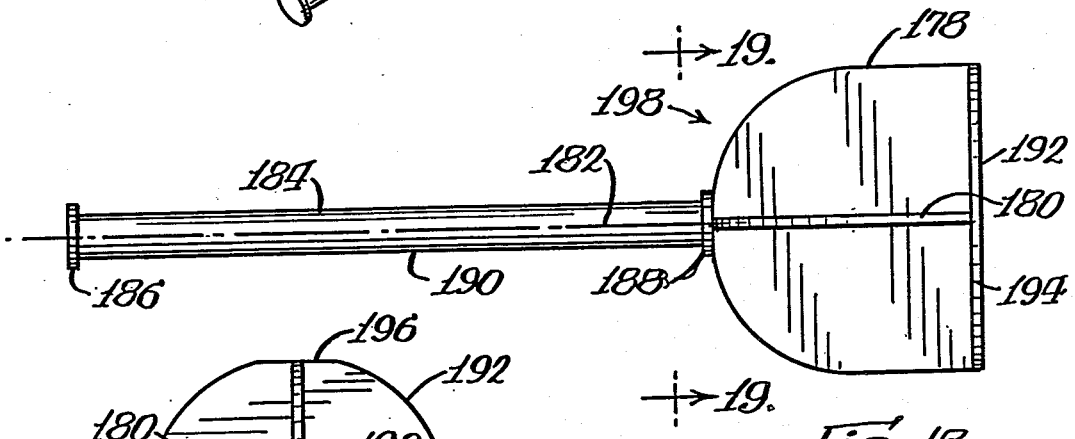
Fig. 18.
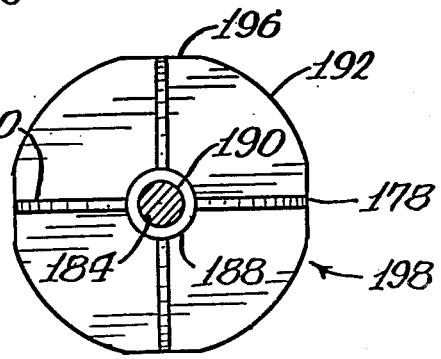
Fig. 19.

AQUATIC NECK EXERCISE ASSEMBLY

CROSS REFERENCES TO RELATED APPLICATIONS

This application is a continuation-in-part of U.S. patent application Ser. No. 310,788, filed Oct. 13, 1981, now U.S. Pat. No. 4,416,451, for an Aquatic Exercise Assembly, which is a continuation-in-part of U.S. patent application Ser. No. 79,966, filed Sept. 28, 1979, now U.S. Pat. No. 4,311,306, issued Jan. 19, 1982, for an Aquatic Exercise Assembly.

BACKGROUND OF THE INVENTION

This invention relates to an exercise assembly, and more particularly, to an exercise assembly for use in water.

Over the years, a variety of weight lifting and exercise devices such as barbells, have been developed. Typifying these weight lifting and exercise devices and other devices are those shown in U.S. Pat. Nos. 373,692; 654,097; 660,962; 717,041; 1,366,200; 1,676,689; 2,143,337; 3,260,523; 3,427,022; 3,671,988; 3,889,306; 4,029,312; 4,227,273; U.S. Design Pat. Nos. Des. 1,906,045 and 495,769; German Pat. No. 351,627; and Italian Pat. No. 615,402. These weight lifting and exercise devices have met with varying degrees of success.

Many of the conventional weight lifting and exercise devices, however, are relatively awkward, cumbersome, and complex, and are not suitable for interchangeable use by men, women, and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional exercise devices exert an excess amount of torque and torsion (twist) on the joints of the user and are, therefore, not usually suitable for many types of physical therapy.

It is therefore desirable to provide an exercise assembly which overcomes most, if not all, of the above disadvantages.

SUMMARY OF THE INVENTION

A novel aquatic helmet aquatic exercise assembly is provided for use in exercising underwater to strengthen muscles, improve muscle tone and enhance muscular coordination of the neck, back, and stomach, and other parts of the body. Advantageously, the aquatic helmet exercise assembly is readily useable by men, women and children alike, having different strengths and physical capabilities without substantial modification.

The aquatic helmet exercise assembly is particularly useful for athletes and for physical therapy in water, because the hydrodynamic torque, torsion and resistive forces which it exerts on the vertebrae, neck and stomach of the athlete or patient, can be readily controlled by the user or a physical therapist by simply varying the acceleration, momentum or rate of movement of the exercise assembly to the desired amount in the water. Desirably, the aquatic helmet exercise assembly is easy to use, effective and relatively simple in design and construction for economy of manufacture.

To this end, the aquatic helmet exercise assembly has a substantially rigid cap which covers the user's head and one or more straps to secure the cap to the forehead, chin and/or neck of the user. Preferably, the cap covers the top, sides and back of the user's head and the straps are adjustable.

At least one water-engageable fin, also referred to as a blade, extends generally upwardly from the cap for engaging and deflecting water and exerting hydrodynamic fluid resistive forces and torque upon the user's neck, back and stomach as the exercise assembly is moved in the water. A hydrodynamic crown or top, such as a pyramid, curved or yamahkee-shaped top, can be mounted on top of the fins to minimize fluid resistance and hydrodynamic pressure when the helmet is being moved upwardly, forwardly or ahead in the water, so that the user can readily and safely swim to the surface or sides of a pool, and to substantially increase the fluid resistance and hydrodynamic pressure exerted on the neck, back and stomach of the user when the helmet is moved downwardly, rearwardly or in a feetwise direction in the water.

More than one fin is preferably used to provide at least part of the hydrodynamic resistance assembly. The fins can have flat or curved edges and can be of various shapes and at various angular relationships to each other. A circumferential or arcuate rim or visor fin can also be used. While the fins and top can have openings or fluid flow passageways, it is preferred that they are imperforate and solid to prevent water from passing therethrough. The cap can be solid, but preferably has fluid openings therein to decrease the overall weight of the helmet and minimize fluid resistance and material costs.

Other types of aquatic exercise assemblies are also disclosed.

A more detailed explanation of the invention is provided in the following description and appended claims taken in conjunction with the accompanying drawings.

BRIEF DESCRIPTION OF THE DRAWINGS

FIG. 14 is a perspective view of another barbell-like blade-type of aquatic exercise assembly in accordance with principles of the present invention;

FIG. 15 is an enlarged front view of the aquatic exercise assembly of FIG. 14;

FIG. 16 is a cross-sectional view of the aquatic exercise assembly of FIG. 14 taken substantially along line 16—16 of FIG. 15;

FIG. 17 is a perspective view of another aquatic exercise assembly in accordance with principles of the present invention;

FIG. 18 is a front view of the aquatic exercise assembly of FIG. 17;

FIG. 19 is a cross-sectional view of the aquatic exercise assembly of FIG. 17 taken substantially along the line 19—19 of FIG. 18;

DETAILED DESCRIPTION OF THE PREFERRED EMBODIMENTS

Figure 1:
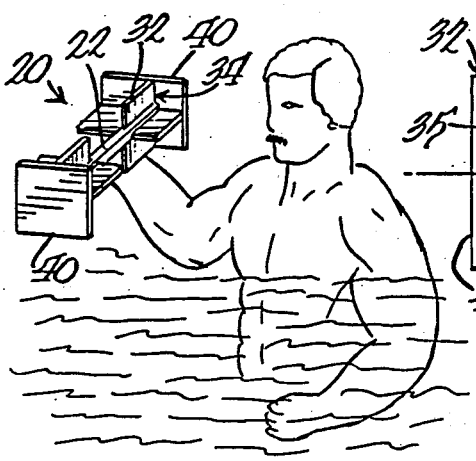
FIG. 1 is a perspective view of a barbell-like blade (fin) type of aquatic exercise assembly being lowered into the water by a weight lifter in accordance with principles of the present invention.
Figure 2:
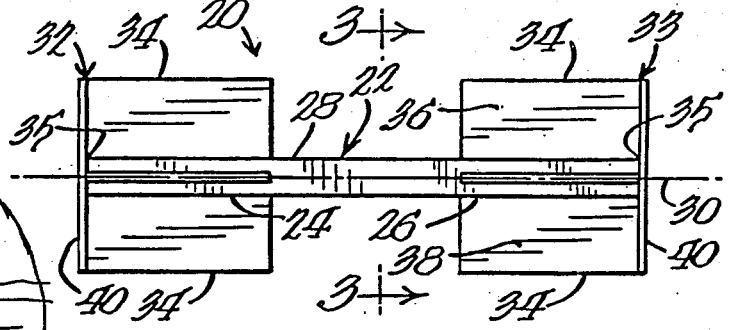
FIG. 2 is an enlarged front view of the aquatic exercise assembly of FIG. 1.
Figure 3:
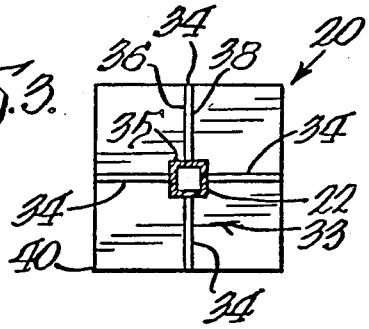
FIG. 3 is a cross-sectional view of the aquatic exercise assembly of FIG. 1 taken substantially along line 3—3 of FIG. 2.

Referring now to FIGS. 1–3 of the drawings, a barbell-like blade or fin type of aquatic exercise assembly 20, sometimes referred to as an aquatic exerciser, is shown for use in water by weight lifters, patients, parapalegics, and other persons desirous of strengthening their muscles, improving their muscle tone, and enhancing their muscular coordination. Exercise assembly 20 is helpful to improve the cardiovascular system and general well being and strength of the user.

Structurally, exercise assembly 20 has a water-engageable, shaft, rod or bar 22 that is formed of a substantially water-impermeable and impact-resistant material, such as light weight aluminum or plastic. Shaft 22 has a left-hand blade-receiving portion 24 (FIG. 2) at one end, a right-hand blade-receiving portion 26 at the other end, and a manually grippable handle portion 28 that is positioned intermediate and between and which connects blade-receiving portions 24 and 26. In the embodiment shown, shaft 22 has a square cross section to facilitate gripping and is tubular to minimize weight and reduce construction costs.

In the illustrative embodiment, shaft 22 is generally rigid or stiff with the handle portion 28 spanning a length somewhat greater than the span of two hands so that it can be gripped by either one or two hands. While the illustrated embodiment is the preferred type of barbell-like exercise assembly, in some circumstances, it may be desirable that the shaft be solid or of a different shape, such as being cylindrical with knurled or other finger gripping portions, or that the shaft be more flexible or that the handle portion be somewhat larger or smaller.

Shaft 22 is elongated and is generally straight or linear so as to extend along axis 30 (FIG. 2). The shaft has a width taken in a radial direction that is generally transverse to the axis 30.

Shaft 22 also serves to rigidify and connect a pair of diametrically opposed hydrodynamic resistance assemblies 32 and 33 that are coaxially connected and secure to blade-receiving portions 24 and 26, respectively, of the shaft. Each hydrodynamic resistance assembly 32 and 33 has a plurality of angularly disposed water-engageable radial blades or fins 34. Blades 34 extend radially from the shaft and serve to deflect water and create a pressure head and fluid resistance to water flow as the shaft is moved in or through the water. Blades 34 are generally planar or flat and are formed of the same material as the shaft. Preferably, there are at least two pairs of diametrically opposed blades 34 at each end of the shaft. In the illustrative embodiment, each of the two sets of diametrically opposed blades are positioned generally perpendicular or at right angles to each other and each of the adjacent blades 34 cooperate with each other to define an angular aquatic pocket 35 for cuppingly engaging water as shaft 22 is moved in the water.

Each of the radial blades 34 has a pair of opposed generally flat water-impingement surfaces 36 or 38 which have a generally rectangular cross-sectional area. In use, one of the water-impingment surfaces 36 or 38 is positioned generally normal or perpendicular to the direction of movement of the shaft 22 to hydrodynamically engage the water as the shaft is moved in the water. Water-impingement surfaces 36 and 38 span a radial width or height that is substantially greater than the width of the shaft 22, taken in a direction transverse to axis 30, to increase or intensify the water resistance of the water-impingement surfaces. The water resistance (resistive forces) exerted by blades 34 as shaft 22 is moved in the water can be increased by increasing the radial span or cross-sectional area that is positioned generally normal to the direction of movement of the shaft 22.

The blades 34 of each of the hydrodynamic resistance assemblies 32 and 33, respectively, are spaced an effective distance from the handle portion 28 of the shaft 22 to exert a hydrodynamic torque on the handle portion as the shaft is moved in or through the water so as to strengthen the muscles of the user of the aquatic exercise assembly. If the user's hand is held in the middle of the shaft and the shaft is rotated or pivoted, the torque exerted by the blades extending from the left hand side of the shaft will counterbalance and offset the torque exerted by the blades extending from the right hand side of the shaft 22.

A transverse blade or fin 40 is secured to each end of shaft 22 at a position generally normal to and abuttingly engaging radial blades 34. Transverse blades 40 create an axial pressure head and fluid resistance to the water when shaft 22 is moved axially in or through the water. In the illustrative embodiment, transverse blade 22 is positioned axially outward of radial blades 32, and is generally rectangular and generally planar or flat. In some circumstances, it may be desirable to position the transverse blades axially inwardly of the radial blades.

While the number of blades illustrated in FIGS. 1–3 are preferred, it may be desirable in some circumstances to have more or less blades at each end of the shaft or at different angles, or that the blades be curved or twisted or of a different shape or formed of a different material.

In use, the aquatic exercise assembly 20 is moved or swung in the water at a selected acceleration and momentum to create the desired resistance, torque and torsion upon the arms of the person using the exercise assembly.

Figure 4:
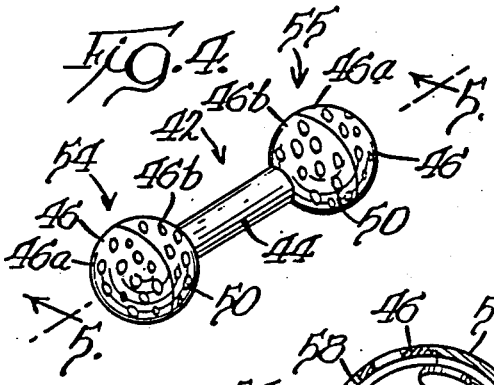
FIG. 4 is a perspective view of a barbell-like ball type of aquatic exercise assembly in accordance with principles of the present invention.
Figure 5:
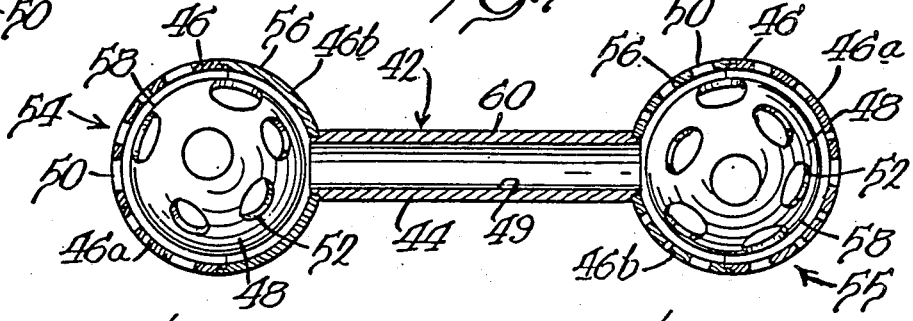
FIG. 5 is an enlarged cross-sectional view of the aquatic exercise assembly of FIG. 4 taken substantially along the line 5—5 of FIG. 4.

Referring now to FIGS. 4 and 5, a barbell-like ball-type of aquatic exercise assembly 42 is shown for use in water. Ball-type exercise assembly 42 is similar to blade-type exercise assembly 20 (FIGS. 1–3) except that each of the ends of the water-engageable shaft or rod 44 securely carries a generally spherical water-engageable outer hollow shell 46 that houses an internal hollow ball 48 and shaft 44 defines a fluid-flow passageway 49 in fluid communication with the outer shells 46 and internal ball 48. Each outer shell 46 is coaxially and fixedly connected to the end of bar 24 and defines a plurality of fluid-flow apertures or holes 50 therein. Outer shell 46 is preferably made of two semi-spherical complementary cup-like parts **46*a* and 46*b* (FIG. 4**) which are detachably connected to each other, such as by complementary threads, snaps or tabs.

Internal ball 48 is hydrorotatably positioned within its associated shell 50 and defines a plurality of fluid-flow openings or holes 52 that are positioned in fluid communication with shell apertures 50 to accommodate passage of water through the internal ball 48 and outer shell 46 as the exercise assembly 42 is moved in the water. Each internal ball 48 and its associated outer shell 46 cooperate with each other to provide a hydrodynamic resistance assembly 54 or 55 that deflects water flow as shaft 44 and exercise assembly 42 are moved in the water.

Outer shell 46 and internal ball 48 are each preferably formed of a substantially water-impermeable impact-resistant material, such as aluminum or impact resistant plastic, as is shaft 44. Outer shell 46 and internal ball 48 each provide a water-impingement surface 56 and 58 (FIG. 5), respectively, with a circular cross-sectional area for positioning generally normal or perpendicular to the direction of movement of shaft 44 in the water. Water-impingement surfaces 56 and 58 hydrodynamically engage the water as exercise assembly 42 is moved in or through the water.

The diameter of the outer shell's water-impingement surface 56 is substantially greater than the width of shaft 44 to increase or intensify the water resistance of outer shell 46. In the preferred form of ball-type of exercise assembly 42 (FIGS. 4 and 5), internal ball 48 is slightly smaller than outer shell 46 and has a circular cross-sectional area of a diameter substantially greater than the width of shaft 44 to enhance the water resistance of the hydrodynamic resistance assemblies 54 and 55.

The outer shell 46 and internal ball 48 of each hydrodynamic resistance assembly 54 and 55 are spaced an effective distance from the manually grippable handle portion 60 of shaft 44 to exert a hydrodynamic torque on the handle portion 60 as shaft 42 is moved in or through the water. If the user's hands are held in the middle of shaft 44 and the shaft is rotated or pivoted, the torque exerted by each hydrodynamic resistance assembly 54 and 55 counterbalance and offset each other.

The ball type of aquatic exercise assembly 42 (FIGS. 4 and 5) provides many similar advantages as the blade-type of aquatic exercise assembly 20 (FIGS. 1–3) and is used in a similar manner. As shaft 44 is moved or swung in the water, internal balls 48 rotate and spin within the interior of shells 46.

Figure 6:
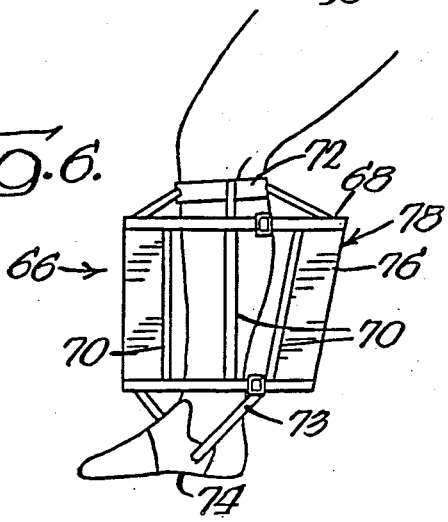
FIG. 6 is a perspective view of a blade-type aquatic exercise assembly that has been strapped onto the user's legs in accordance with principles of the present invention.

The blade or fin type of aquatic leg exercise assembly 66 shown in FIG. 6 is similar in many respects to the blade-type aquatic exercise assembly shown in FIGS. 1–3. Leg exercise assembly 66 has a flexible frame structure or assembly 68 connected to a plurality of elongated circumferentially spaced, generally upright shafts or bars 70. Frame 68 has an upper flexible strap 72 for connection to the person's leg and has lower flexible straps 73 connected to a stirrup 74 that fits upon the person's foot. Straps 72 and 73 and shafts 70 provide manually grippable handle portions which are readily graspable by the user of the leg exercise assembly 66. Each upright shaft 70 is axially connected to a generally upright water-engageable blade or fin 76. Each blade is preferably generally flat or planar with a rectangular shape. In some circumstances, however, it may be desirable that the blades be curved or of a different configuration. Collectively, blades 76 provide a hydrodynamic resistance assembly 78 to deflect water and create a pressure head and fluid resistance to water flow as the exercise assembly 66 is moved in the water.

Figure 7:
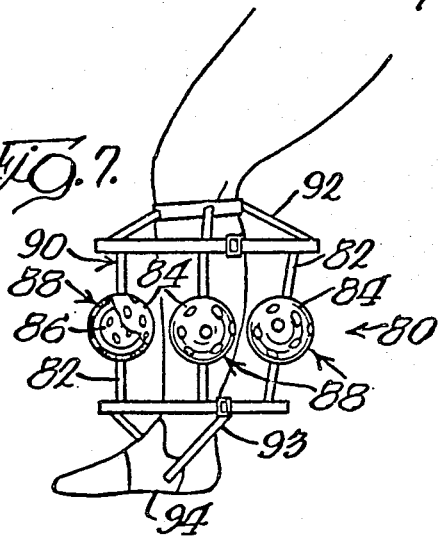
FIG. 7 is a perspective view of a ball-type aquatic leg exercise assembly that has been strapped onto the user's leg in accordance with principles of the present invention.

The ball-type of aquatic leg exercise assembly 80 shown in FIG. 7 is similar to the blade-type of aquatic exercise assembly 66 shown in FIG. 6, except that each shar or bar 82 securely carries at least one water-engageable hollow outer shell 84 that houses an internal hollow ball 86. Each outer shell 84 and internal ball 86 are structurally and functionally similar to the shells 46 and balls 48, respectively, of the barbell-like exercise assembly 42 shown in FIGS. 4 and 5, and provide a hydrodynamic resistance assembly 88. Frame 90, straps 92 and 93 and stirrup 94, respectively, are substantially identical to the frame 68, straps 72 and 73 and stirrup 74, respectively, shown in FIG. 6.

Figures 8, 9, 10, 11, 12, 13:
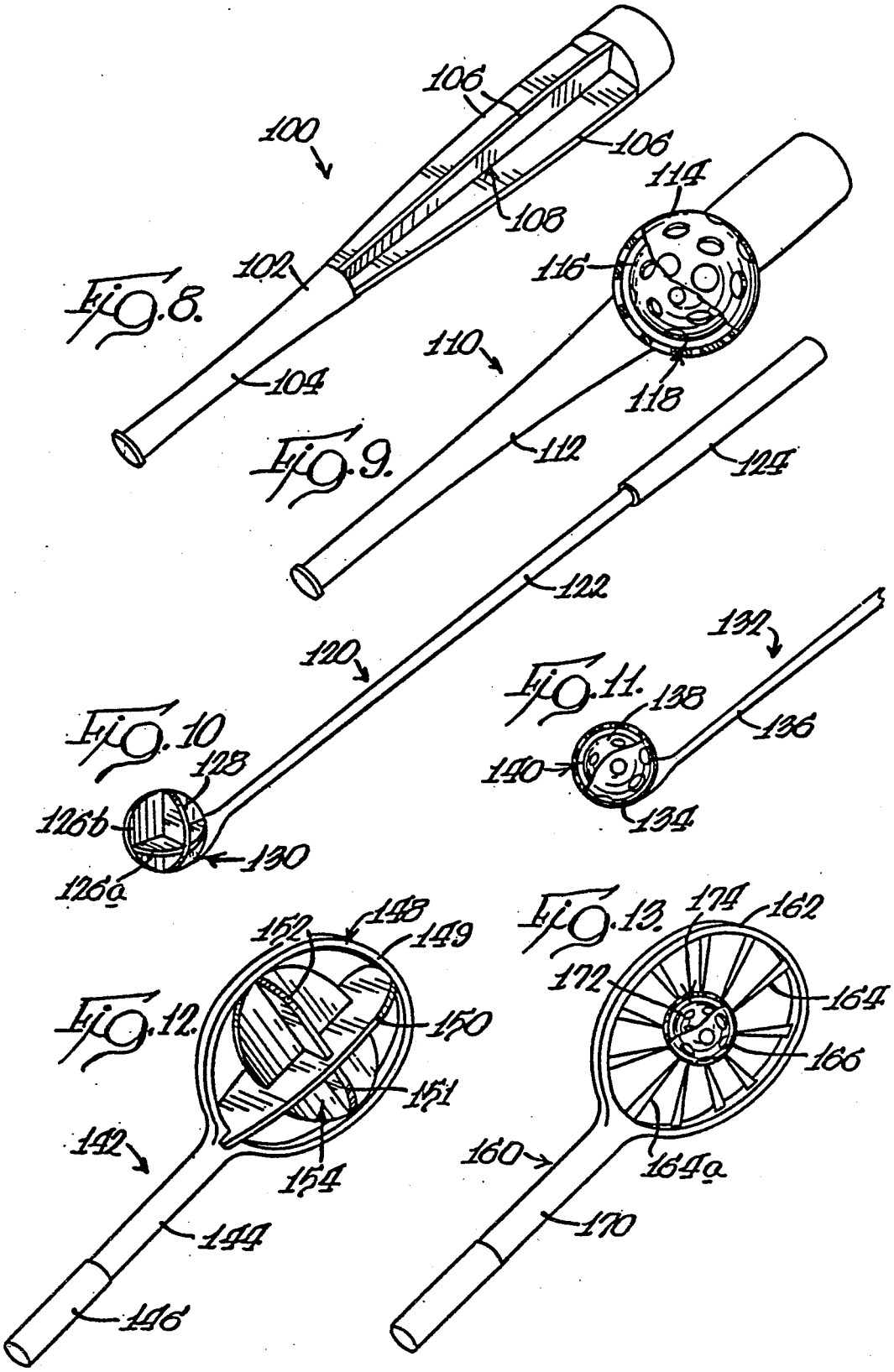
FIG. 8 is a perspective view of a bat-like blade-type of aquatic exercise assembly in accordance with principles of the present invention.
FIG. 9 is a perspective view of a bat-like ball-type of aquatic exercise assembly with portions shown in cross section in accordance with principles of the present invention.
FIG. 10 is a perspective view of a golf club-like blade-type of aquatic exercise assembly in accordance with principles of the present invention.
FIG. 11 is a fragmentary perspective view of a golf club-like ball-type of aquatic exercise assembly with portions shown in cross section in accordance with principles of the present invention.
FIG. 12 is a perspective view of a racquet-like blade-type of aquatic exercise assembly in accordance with principles of the present invention.
FIG. 13 is a perspective view of a racquet-like blade-type of aquatic exercise assembly in accordance with principles of the present invention.

The bat-like blade-type of aquatic exercise assembly 100 of FIG. 8 has a generally solid water-engageable shaft 102. Shaft 102 is in the form of a baseball bat or club with a manually grippable handle portion 104. Exercise assembly 100 has two sets of diametrically opposed generally flat blades or fins 106 that provide a hydrodynamic resistance assembly 108. Blades 106 are tapered inwardly towards handle 104 and are positioned at right angles to each other. Blades 106 operate in the water similarly to the radial blades 32 of the barbell-type of aquatic exercise assembly 20 shown in FIGS. 1–3. If desired, curved blades, or blades having a different shape, or blades positioned at different angular relationship can be used.

The bat-like ball-type of aquatic exercise assembly 110 shown in FIG. 9 is similar to the bat-like aquatic exercise assembly 100 shown in FIG. 8, except that the outer end of the bat-like water-engageable shaft 112 securely carries a water-engageable hollow outer shell 114 that houses an internal ball 116. Outer shell 114 and internal ball 116 are structurally and functionally similar to shells 46 and balls 48, respectively, of the exercise assembly 42 shown in FIGS. 4 and 5, and cooperate together to provide a hydrodynamic resistance assembly 118.

The golf club-like blade-type of aquatic exercise assembly 120 shown in FIG. 10 has an elongated water-engageable shaft or shank 122 in the form of a golf club with a manually grippable handle portion 124 and blades or fins 126*a*, 126*b*, and 128 that cooperate with each other to provide the head of the club. The blades include a semi-circular axial blade 126*a* and a generally circular axial blade 126*b*, that are positioned at right angles to each other, as well as a transverse semi-circular blade 128. The transverse semi-circular blade abuts against, intersects and is positioned generally normal to the axial blades. Blades 126*a*, 126*b*, and 128 cooperate with each other to provide a hydrodynamic resistance assembly 130 and function similarly to blades 32 and 40, respectively, of the exercise assembly 20 shown in FIGS. 1–3.

The golf club-like ball-type of aquatic exercise assembly 132 of FIG. 11 is similar to the golf club-like aquatic exercise assembly 120 of FIG. 10, except that the head at the end of shaft or shank 136, contains a water-engageable hollow outer shell 134 that house an internal hollow ball 138, in lieu of blades. Outer shell 134 is securely connected to the end of shaft 136, while internal ball 138 is free to rotate and spin within the interior of shell 138 as the exercise assembly 132 is moved in the water. Outer shell 134 and internal ball 138 are structurally and functionally similar to the shells 46 and balls 48, respectively, of exercise assembly 42 (FIGS. 4 and 5) and cooperate with each other to provide a hydrodynamic resistance assembly 140.

The raquet-like blade-type of aquatic exercise assembly 142 shown in FIG. 12 has a shaft or shank 144 in the form of a racquet with a manually grippable handle portion 146 and a racquet-like head 148. Racquet-like aquatic exercise assembly 142 can be in the form of a tennis racquet, racquetball racquet, lacrosse racquet, squash racquet, jai alai racquet, paddle, etc. Head 148 has an elliptical rim 149 that is connected to two water-engageable generally elliptical axial blades or fins 150 and 151, and a generally elliptical transverse fin 152. Axial blade 150 is secured to the upper end of shaft 144 and spans a greater length than the other blades 151 and 152. Blades 150, 151, and 152 function similarly to blades 32 and 49, respectively, of the exercise assembly 20 shown in FIGS. 1–3 and provide a hydrodynamic resistance assembly 154.

Referring now to FIG. 13, the racquet-like ball-type of aquatic exercise assembly 160 shown therein is similar to the racquet-like blade-type of aquatic exercise assembly 142 shown in FIG. 12, except that racquet head 162 has radial spokes 154 that are secured to a water-engageable hollow outer shell 166 in lieu of blades. Outer shell 166 is axially secured to shaft or shank 170 via axial spoke 164*a* and houses an internal hollow ball 172. Outer shell 166 and internal ball 172 are structurally and functionally similar to the shells 46 and balls 48, respectively, of exercise assembly 42 of FIGS. 4 and 5, and cooperate with each other to provide a hydrodynamic resistance assembly 174.

Referring now to FIGS. 14–16, the barbell-like or dumb bell-like blade-type aquatic exercise assembly 176 shown therein provides an aquatic dumb bell which is similar to the barbell-like aquatic exercise assembly 20 of FIGS. 1–3, except that the radial fins 178 have axial engaging portions 180 extending across their entire length which are secured to and touch each other in coaxial alignment with the axis 182 of shaft 184 and are secured to and extend radially outwardly of fin-engageable end portions or butts 186 and 188 at the end of the shaft. Fin-engageable end portions 186 and 188 have a transverse diametric thickness or height greater than the manually grippable portion 190 of shaft 182. Transverse fins or end plates 192 abut flush against and are secured to the outer transverse radial edges 194 of radial fins 178.

In the embodiment shown in FIGS. 14–16, transverse fins 192 are circular and radial fins 178 are the shape of a quadrant or a quarter of a circle. End portions 186 and 188 of shaft 184 are circular discs, and shaft 184 is cylindrical. Circular fins 192 can have flat portions 186 (FIG. 16) which are spaced apart from each other to minimize rolling when the exercise assembly is laid on the floor or a pool deck. Transverse and radial fins 192 and 178, as well as end portions 186 and 188, can also be rectangular, preferably square, with rounded corners to avoid scratching or accidentally puncturing the skin and to enhance safety. Shaft 184 can have a square or polygonal cross-section and can be solid or tubular.

Fins 178 and 192 each have generally planar or flat, imperforate, water-impingement surfaces which provide solid, water impermeable cross-sectional areas or barriers. The maximum height of radial fins 178 are more than twice the maximum thickness of the manually grippable portion 190 of shaft 184. Transverse fin 192 spans a distance at least as great as the maximum diametric span or height of the radial fins 178 and occupies an area enclosing the radial fins.

In the embodiment shown in FIGS. 14–16, there are two sets of diametrically opposed radial fins 178 at each end of the shaft 184 which are positioned generally at right angles to each other to define angular aquatic pockets to cuppingly engage water as the aquatic exercise assembly is moved in the water. It may be desirable in some circumstances that there be more or less radial fins, or that the radial fins be spaced at greater or less than at right angles to each other, or that the radial fins be curved or twisted or have some other shape. Auxiliary fins can be bolted, clamped or otherwise secured to the radial fins and transverse fins to increase the effective height of the fins. The aquatic exercise assembly 176 can come in various sizes with larger sizes for men and more compact and smaller sizes for women and children.

The aquatic exercise assembly 198 shown in FIGS. 17–19 is substantially similar to the exercise assembly 176 shown in FIGS. 14–16, except that the radial fins 178 are secured to only one end, end portion 188, of shaft 184. Shaft 184 and fins 178 can be very long or relatively short with respect to each other depending on the preference of the user. Exercise assembly 176 provides an aquatic bat for a baseball player, an aquatic tennis racquet for a racquetball player, and an aquatic golf club for a golfer.

Figure 20:
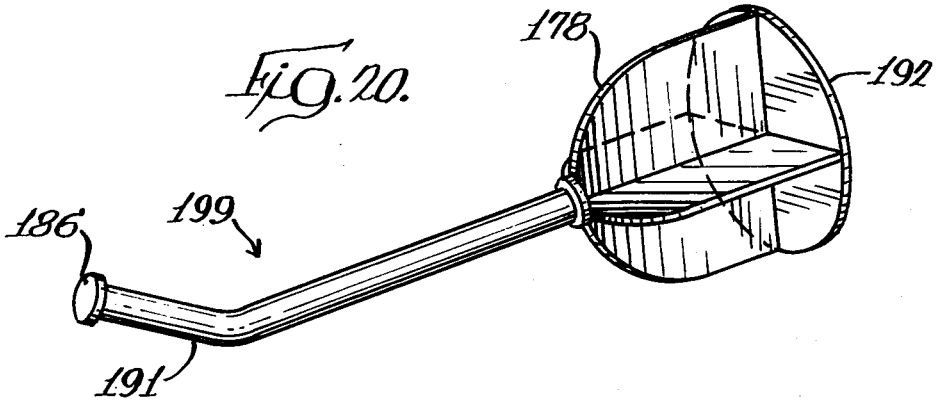
FIG. 20 is a perspective view of an aquatic baseball bat exercise assembly in accordance with principles of the present invention.
Figure 21:
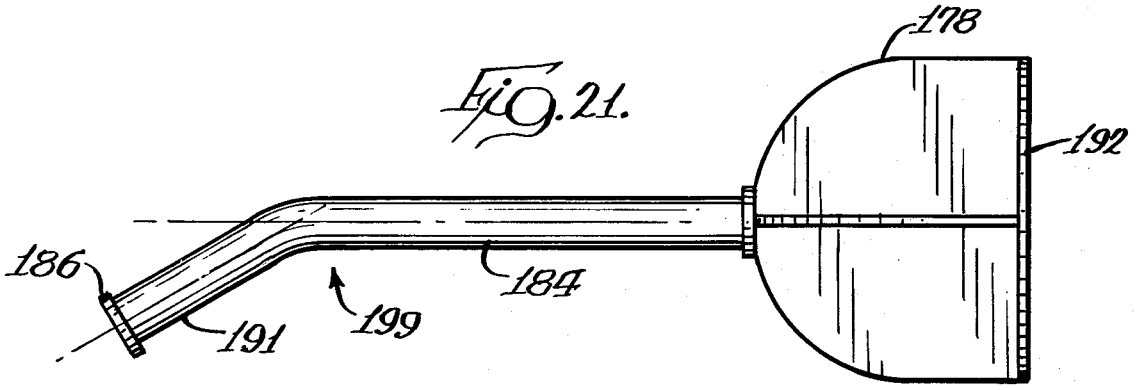
FIG. 21 is a front view of the aquatic baseball bat exercise assembly of FIG. 20.

The aquatic baseball bat exercise assembly 199 shown in FIGS. 20 and 21 is similar to the exercise assembly 198 shown in FIGS. 17–19, except that the handle or manual grippable portion 191 is bent at an obtuse angle of inclination from 170 degrees to 100 degrees, preferably from 120 degrees to 150 degrees, and most preferably 135 degrees, relative to shaft 184. Handle 191 should be of sufficient length to comfortably fit one or both hands of the user as desired. The bent handle helps simulate a proper swing, strengthens the wrists, forearms and other muscles of the user used in swinging the aquatic bat, as the aquatic bat 199 is pivotally moved or swung through the water. While fins 178 and 192 are preferably rounded, other shaped fins such as rectangular or square fins or fins connected to the shaft as shown at either end of the exercise assembly of FIG. 2 can be used. The aquatic bat can also have more or less fins, if desired.

Figure 22:
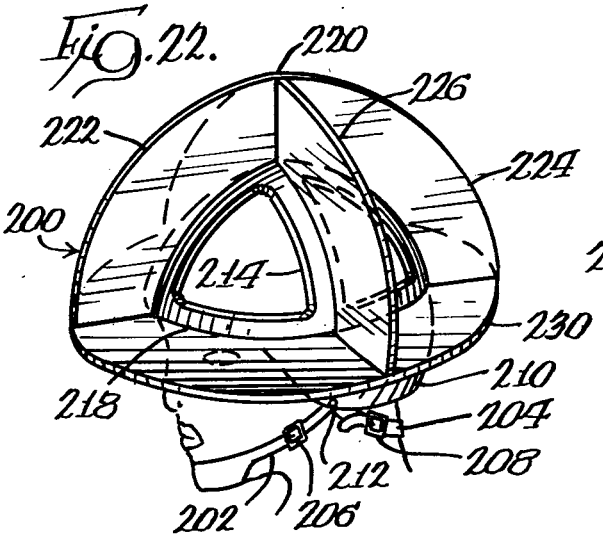
FIG. 22 is a perspective view of an aquatic helmet exercise assembly securely strapped to a person's head in accordance with principles of the present invention.
Figure 23:
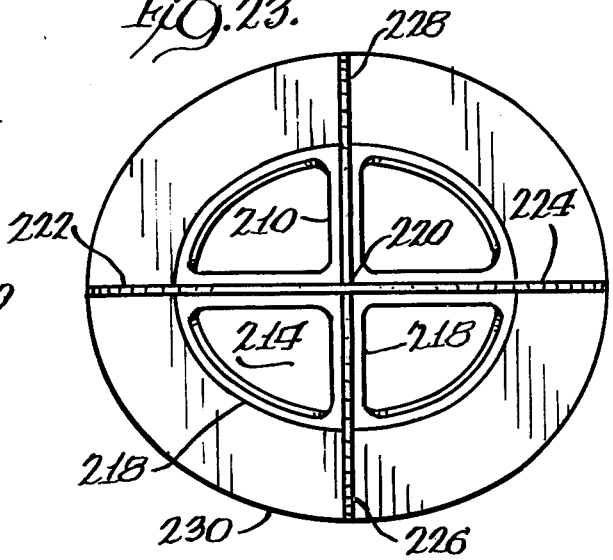
FIG. 23 is a top view of the aquatic helmet exercise assembly of FIG. 22.
Figure 24:
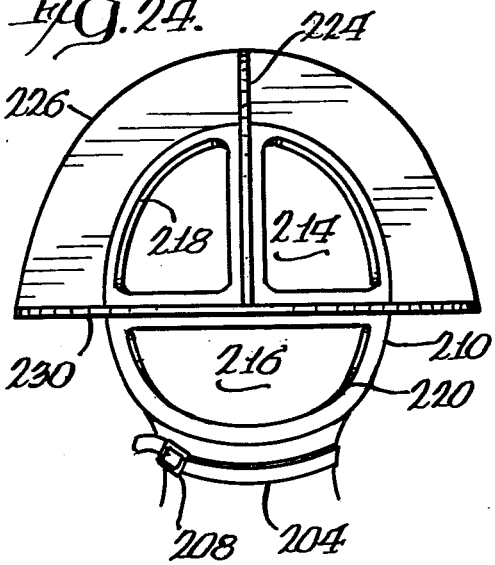
FIG. 24 is a rear view of the aquatic helmet exercise assembly of FIG. 22.

The aquatic helmet exercise assembly 200 shown in FIGS. 22–24 is used by athletes, body builders, exercisers, patients, parapalegics and other persons desirous of strengthening their muscles and improving muscle tone in their stomach and back, stretching their vertebrae and enhancing muscular coordination. It can be used by men, women and children alike without changing, adding or removing parts and components, by simply adjusting the effective length and tightness of flexible straps 202 and 204 with buckles 206 and 208, respectively. In use, the aquatic helmet exercise assembly is moved through the water by various head movements, such as by turning or nodding the head, jumping, squatting, doing knee bends, swimming, or walking forwards, backwards or sideways while completely underwater, or by pulling or pushing away from the sides or ladder of a pool.

The aquatic helmet exercise assembly is helpful to improve the cardiovascular system and physical well being of the user. By controlling the rate of one's head movements in the water, the rate of the hydrodynamic resistive forces, torque and pressure head exerted by the exercise assembly on the neck, stomach and back of the user can be regulated to the desired amount, while minimizing harsh impact forces and shock and preventing whiplash and uncomfortable twisting of the user's neck.

Straps 202 and 204 secure a cap or helmet 210 to the neck and back of the user's head, respectively. The straps can be made of silicone rubber, plastic or a fabric impregnated or coated with a water proofing material. The straps can be tied, riveted or otherwise fastened to the cap 210, such as with fastener 212. A chin strap can be used with or in lieu of the neck strap 202. In some cases, it may be desirable to omit the rearward strap 204 and/or use a headband strap about the forehead and upper part of the head to adjust for different cap sizes.

The cap 210 provides a protective helmet which covers the top, sides and back of the head. Although the cap can be solid and imperforate, it is preferred that the cap is molded or fabricated with openings or holes 214 and 216 for decreased weight and economy of material, as well as to provide fluid flow passageways in the cap. In the embodiment of FIGS. 22–24, there are four upper holes 214 which are generally triangular or quadrant shaped and a semicircular bottom hole 216 (FIG. 24) at the lower back portion of the helmet. Quadrant shaped ribs 218 surround and define the upper holes 214 and a semicircular rib 220 surrounds and defines the bottom hole 216. If desired, the holes and ribs can be of other shapes and sizes, and more or less holes can be molded or fabricated. An optional sponge rubber liner can be placed on the inside of the cap to cushion the user's head, if desired. While the described cap is preferred, it may be desirable for some users, that the sides and back portion of the cap be omitted.

Extending integrally outwardly from the cap are elongated water-engageable fins 220, also referred to as blades, which provide at least part of the hydrodynamic resistance assembly. The fins are substantially solid, imperforate and generally planar or flat. The fins and cap are made of a substantially rigid, water impervious material, such as a impact resistant plastic. In the illustrated embodiment, the fins are integrally molded and connected to the cap, such as by injection molding, and the fins and cap are made of polypropylene. The fins and cap can be made of other plastics, or plastic reinforced with graphite or glass, or a non-corrosive light weight metal, such as aluminum, if desired. Although the preferred fins and cap are rigid to maximize hydrodynamic fluid resistive forces, in some circumstances it may be desirable that the outer portions of the fins, adjacent their outer peripheral edges, and the sides and/or back of the cap, or other portions of the fins and cap be slightly flexible or bendable.

In the embodiment of FIGS. 22–24, the fins 220 include generally upright fins 222, 224, 226 and 228 and an optional generally horizontal annular rim fin 230. The outer edges of the fins are curved and arcuate. The upright fins are cross-shaped as viewed from the top and include a pair of longitudinal diametrically opposed upright fins 222 and 224 and a pair of transverse or lateral, diametrically opposed upright side fins 226 and 228. The fins each have generally planar or flat, solid water-engageable opposed surfaces for engaging and deflecting the water. The longitudinal fins include a forward front fin 222 extending generally upwardly and forwardly of the cap, and a rearward back fin 224 extending generally upwardly and rearwardly of the cap. The front and back fins 222 and 224 are in coplanar relationship and alignment with each other. The longitudinal fins extend generally along a symmetrical axis or plane of the user's body generally between the user's ears and in alignment with the user's nose. The transverse fins 226 and 228 extend generally upwardly and outwardly of the cap along a transverse plane or axis of the user's body in general alignment with, the user's ears. The peripheral or circumferential rim fin 230 extends horizontally and laterally outwardly of the cap and preferably abuttingly seats against and is connected to the bottom of the upright fins. In the illustrative embodiment, the rim fin is elliptical, although in some circumstances it may be desirable that the rim fin be circular.

In use, the fins of the aquatic helmet exercise assembly 200 exert a hydrodynamic fluid resistive force, torque and pressure head on the head, neck, stomach and back of the user, as the helmet 200 is turned and moved in the water. The laterally facing planar, solid water-engageable surfaces of the front and rear fins 222 and 224 engage and deflect the water and exert a hydrodynamic fluid resistive force, torque and pressure head on the user as the front and rear fins are turned or moved sideways in the water. The forwardly and rearwardly facing planar, solid water-engageable surfaces of the transverse side fins 226 and 228 engage and deflect the water and exert a hydrodynamic fluid resistive force, torque and pressure head on the user as the side fins are turned or moved forward and backwards in the water. The upwardly and downwardly facing, planar solid water-engageable surfaces of the rim fin 230 exerts a hydrodynamic fluid resistive force, torque and pressure head on the user as the rim fin is moved up and down in the water.

Figure 25:
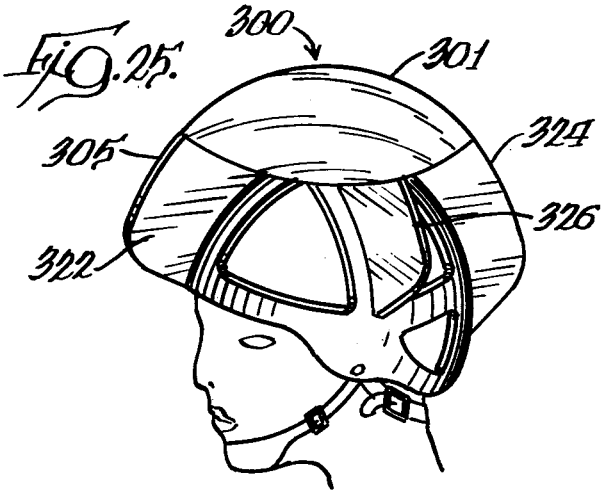
FIG. 25 is a perspective view of another aquatic helmet exercise assembly securely strapped to a person's head in accordance with principles of the present invention.
Figure 26:
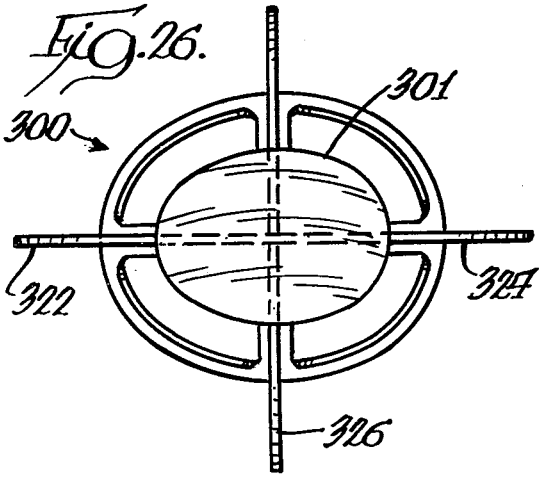
FIG. 26 is a top view of the aquatic helmet exercise assembly of FIG. 25.

The aquatic helmet exercise assembly 300 of FIGS. 25 and 26 is similar to the aquatic helmet exercise assembly of FIGS. 22–24, except that it has a convex rounded crown or hydrodynamic top 301 mounted or otherwise securely connected to the top of the upright fins 322, 324 and 326 and has no rim fin. The upright fins have curved arcuate bottom edges 303. The top 301 is substantially solid and imperforate and is made of a water impervious material, preferably the same material as the fins. The top has the same angle of curvature as the curved elongated edges 305 of the upright fins and is generally the shape of a beanie, skullcap or yamakee. In the preferred embodiment, the top covers slightly less than half the arcuate length of the fins, although the top can be constructed to cover more or less of the fins, as desired. In use, the concave bowl-shaped downwardly facing inner surface of the top provides a pocket which scoops and catches the water as the helmet 300 is moved downwardly in the water so as to exert substantial drag and hydrodynamic fluid resistive forces, torque and pressure head on the head, neck stomach and back of the user. The rounded convex outer surface of the top minimize fluid resistance and exerts substantially less hydrodynamic drag, forces, torque and pressure head on the user when the helmet is moved upward in the water. The upright fins function similarly to the upright fins of the helmet 200 of FIGS. 22–24.

Figure 27:
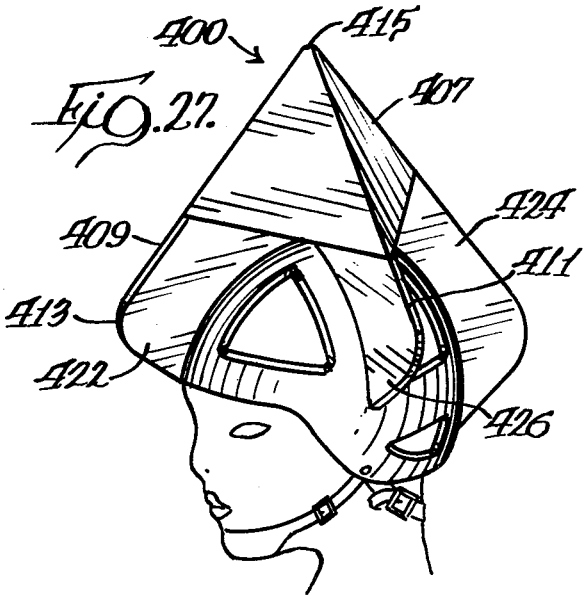
FIG. 27 is a perspective view of a further aquatic helmet exercise assembly securely strapped to a person's head in accordance with principles of the present invention.

The aquatic helmet exercise assembly 400 of FIG. 27 is similar to the aquatic helmet aquatic exercise assembly 300 of FIGS. 25 and 26, except is has a pyramid-shaped hydrodynamic top or crown 407 and the elongated upright edges 409 and 411 of the upright fins 422, 424 and 426 are straight with rounded corners 413. The downwardly facing internal, diverging walls of the pyramid-shaped top provide a cup-like pocket which scoops and catches the water as the helmet 400 is moved downward in the water so as to exert substantial drag and hydrodynamic fluid resistive forces, torque and pressure head on the head, neck, stomach and back of the user. The rounded apex 415 of the top minimizes fluid resistance and exerts substantially less hydrodynamic drag, forces, torque and pressure head on the user when the helmet is moved upward in the water. The upright fins function similarly to the upright fins of the helmets 200 and 300 of FIGS. 22–26.

In the above embodiments, the longitudinal and lateral upright fins of the helmet are perpendicular so as to be at right angles to each other and have flat surfaces. In some circumstances, however, it may be desirable to use more or less upright fins at different angular relationships to each other and/or use fins with curved surfaces in the embodiments of FIGS. 22–27.

Although embodiments of this invention have been shown and described, it is to be understood that various modifications and substitutions can be made by those skilled in the art without departing from the novel spirit and scope of this invention.

What is claimed is:

1. An aquatic helmet exercise assembly for use in exercising underwater to strengthen the user's neck muscles, comprising:

a substantially rigid impact-resistant cap of water-impervious plastic for substantially covering the top, sides and back of the user's head;

adjustable strap means for adjustably securing said cap to the user's neck and head;

longitudinal substantially rigid water-engageable fin means of water-impervious plastic extending generally upwardly, forwardly and rearwardly of said cap along a generally symmetical axis of the user's body generally between the user's ears and in general alignment with the user's nose, said longitudinal fin means having a curved and arcuate outer edge and lateral facing, generally planar, substantially solid water-engageable surfaces for laterally engaging and deflecting the water and exerting hydrodynamic fluid resistive forces and torque on the user's neck as said longitudinal fin means is moved sideways in the water; and transverse, substantially rigid, water-engageable side fin means of water-impervious plastic extending generally upwardly and laterally ouwardly of said cap and positioned generally perpendicular to said longitudinal fin means along a transverse axis of the user's body in general alignment with the user's ears, said transverse side fin means cooperating with said longitudinal fin means to define generally cross-shaped fins as viewed from the top of the aquatic helmet exercise assembly, said transverse side fin means having a curved and arcuate outer edge, said transverse side fin means having a forwardly facing generally planar, substantially solid, water-engageable surface and a rearwardly facing, generally planar, substantially solid, water-engageable surface for engaging and deflecting water and exerting hydrodynamic fluid resistive forces and torque on the user's neck as said transverse side fin means is moved forwardly and backwardly, respectively, in the water.

2. An aquatic helmet exercise assembly in accordance with claim 1 including a rounded, substantially rigid, water-impervious, imperforate solid convex crown secured on said longitudinal and transverse side fin means, said convex crown having a concave downwardly facing inner surface defining a pocket for exerting substantially more fluid resistive force on the user when said convex crown is moved downwardly in the water than when said convex crown is raised in the water.

3. An aquatic helmet exercise assembly in accordance with claim 1 wherein said longitudinal and transverse fin means have generally straight edges with rounded corners and said aquatic helmet exercise assembly has a generally upright, substantially rigid, water-impervious, imperforate pyramid-shaped crown secured on top of said longitudinal and transverse fin means for exerting substantially more fluid resistive force on the user when said pyramid-shaped crown is moved downwardly in the water than when said pyramid-shaped crown is raised in the water.

4. An aquatic helmet exercise assembly in accordance with claim 3 wherein said solid convex crown has generally the same angle of curvature as said curved edges of said longitudinal and transverse side fin means.

5. An aquatic helmet exercise assembly in accordance with claim 4 wherein said convex crown covers slightly less than half the arcuate length of said fin means.

6. An aquatic helmet exercise assembly for use in exercising underwater to strengthen the user's neck muscles, comprising:

substantially rigid water-impervious cap means for at least partially covering the user's head;

flexible water-impervious strap means for securing said cap means to the user's head;

a plurality of generally upright substantially rigid water-impervoius fins intersecting each other at an angle of inclination and extending generally upwardly from said cap means, said fins having arcuate upright outer edges and generally planar water-engageable surfaces for engaging and deflecting water and exerting hydrodynamic fluid resistive forces and torque on the user's neck when moved in the water; and said upright fins including front and back longitudinal fins in coplanar alignment with each other and transverse coplanar side fins at generally right angles to said front and back longitudinal fins.

7. An aquatic helmet exercise assembly in accordance with claim 6 including a solid rounded convex crown secured on top of said upright fins.

* * * * *